US006814313B2

(12) United States Patent
Petrone et al.

(10) Patent No.: US 6,814,313 B2
(45) Date of Patent: Nov. 9, 2004

(54) FUEL INJECTOR FOR AN INTERNAL COMBUSTION ENGINE WITH MULTIHOLE ATOMIZER

(75) Inventors: Michele Petrone, San Lazzaro di Savena (IT); Luca Mancini, Bologna (IT); Massimo Mattioli, Castelmaggiore (IT)

(73) Assignee: Magneti Marelli Powertrain S.p.A., Corbetta (IT)

( * ) Notice: Subject to any disclaimer, the term of this patent is extended or adjusted under 35 U.S.C. 154(b) by 0 days.

(21) Appl. No.: 10/454,941

(22) Filed: Jun. 5, 2003

(65) Prior Publication Data

US 2004/0061006 A1 Apr. 1, 2004

(30) Foreign Application Priority Data

Jun. 7, 2002 (IT) ..... BO2002A0360

(51) Int. Cl.[7] ..... F02M 51/00

(52) U.S. Cl. ..... 239/585.1; 239/585.5; 239/584

(58) Field of Search ..... 239/88–92, 96, 239/533.1–533.5, 533.7, 553.9, 533.15, 585.1, 583, 584, 50, 51, 55

(56) References Cited

U.S. PATENT DOCUMENTS 4,778,107 A 10/1988 Kojima et al. ..... 239/1
6,318,646 B1 11/2001 Mattioli et al. ..... 239/585.1

FOREIGN PATENT DOCUMENTS

EP 1 076 175 2/2001

*Primary Examiner*—Michael Mar
*Assistant Examiner*—Thach H. Bui
(74) *Attorney, Agent, or Firm*—Baker & Daniels

(57) ABSTRACT

Fuel injector having a valve body, which is provided with a valve operated by an electromagnetic actuator and capable of controlling the flow of fuel, and with a cylindrical, tubular container closed by a sealing element; the sealing element is arranged so as to close a lower end of the tubular container, is provided with a multihole atomiser and a valve seat, and is composed solely of a cylindrically symmetrical main body, which comprises the valve seat and ensures fluid-tight closure of the lower end of the tubular container, and of a perforated disc, which is welded coaxially to the main body and defines the multihole atomiser in conjunction with an underlying truncated conical surface defined in the main body.

8 Claims, 2 Drawing Sheets

FUEL INJECTOR FOR AN INTERNAL COMBUSTION ENGINE WITH MULTIHOLE ATOMIZER

The present invention relates to a fuel injector for an internal combustion engine.

The present invention is advantageously applied to controlling an electromagnetic injector in a direct petrol injection system, to which the following description will make explicit reference without consequently restricting the general scope thereof.

BACKGROUND OF THE INVENTION

Currently available injectors for direct petrol injection are relatively costly and of complicated construction.

EP1076175 discloses a fuel injector with a valve body having an inlet, an outlet, and an axially extending fuel passageway from the inlet to the outlet, an armature located proximate the inlet of the valve body, a needle valve operatively connected to the armature, a valve seat proximate the outlet of the valve body, and a swirl generator disk located proximate the valve seat; the swirl generator disk having at least one slot extending tangentially from a central aperture. A flat guide disk having a first surface, a second surface adjacent the flat swirl generator disk, a guide aperture, and at least one fuel passage having a wall extending between the first surface and the second surface; the wall includes an inlet, an outlet, and a transition region between the inlet and the outlet that defines a cross-sectional area of the at least one passage. The transition region is provided by a surface of the wall, and the surface of the wall is configured to gradually change the direction of fuel flowing from the fuel passageway of a valve body to the flat swirl generator disk.

U.S. Pat. No. 6,318,646 discloses a fuel injector comprising a main tubular body provided with at least one through duct that terminates in a spray nozzle adapted to atomise the fuel contained in the through duct, a shutter member moving axially in this through duct from and to a closed position in which the shutter member is disposed in abutment on the spray nozzle closing it off in such a way as to prevent any discharge of fuel, and lastly a hydraulic damper adapted to brake the shutter member during its return to the above-mentioned closed position U.S. Pat. No. 4,778,107 discloses an assembling method of a fuel injection valve for fuel injection into an internal combustion engine, the fuel injection valve including a cylindrical valve body having a fuel passage therein and a through-hole made in a direction of the axis thereof and a cylindrical nozzle coupled to the valve body and having a plurality of injection holes for dividing the fuel exited from the through-hole into a plurality of parts and for injecting the divided fuel parts into the engine. The assembling method comprises the steps of coupling the nozzle to the valve body, rotating the valve body relative to the nozzle, and stopping the rotation of the valve body when the through-hole takes a desirable position relative to the injection holes and fixedly securing the nozzle to the valve body. Preferably, an end portion of the valve body is tapered conically and the nozzle has at least one edge portion at its inside so that the edge portion comes into contact with the tapered portion when the nozzle is coupled to the valve body, the edge portion being made of a material which is deformed non-elastically in response to application of a force. The edge portion is crushed flat when the nozzle is coupled to the valve body.

SUMMARY OF THE INVENTION

The object of the present invention is to produce a fuel injector for an internal combustion engine that does not have the above-stated disadvantages and, in particular, is simple and economic to produce.

BRIEF DESCRIPTION OF THE DRAWINGS

The present invention will now be described with reference to the attached drawings, which illustrate some non-limiting embodiments thereof, in which.

DETAILED DESCRIPTION OF THE INVENTION

Figure 1:
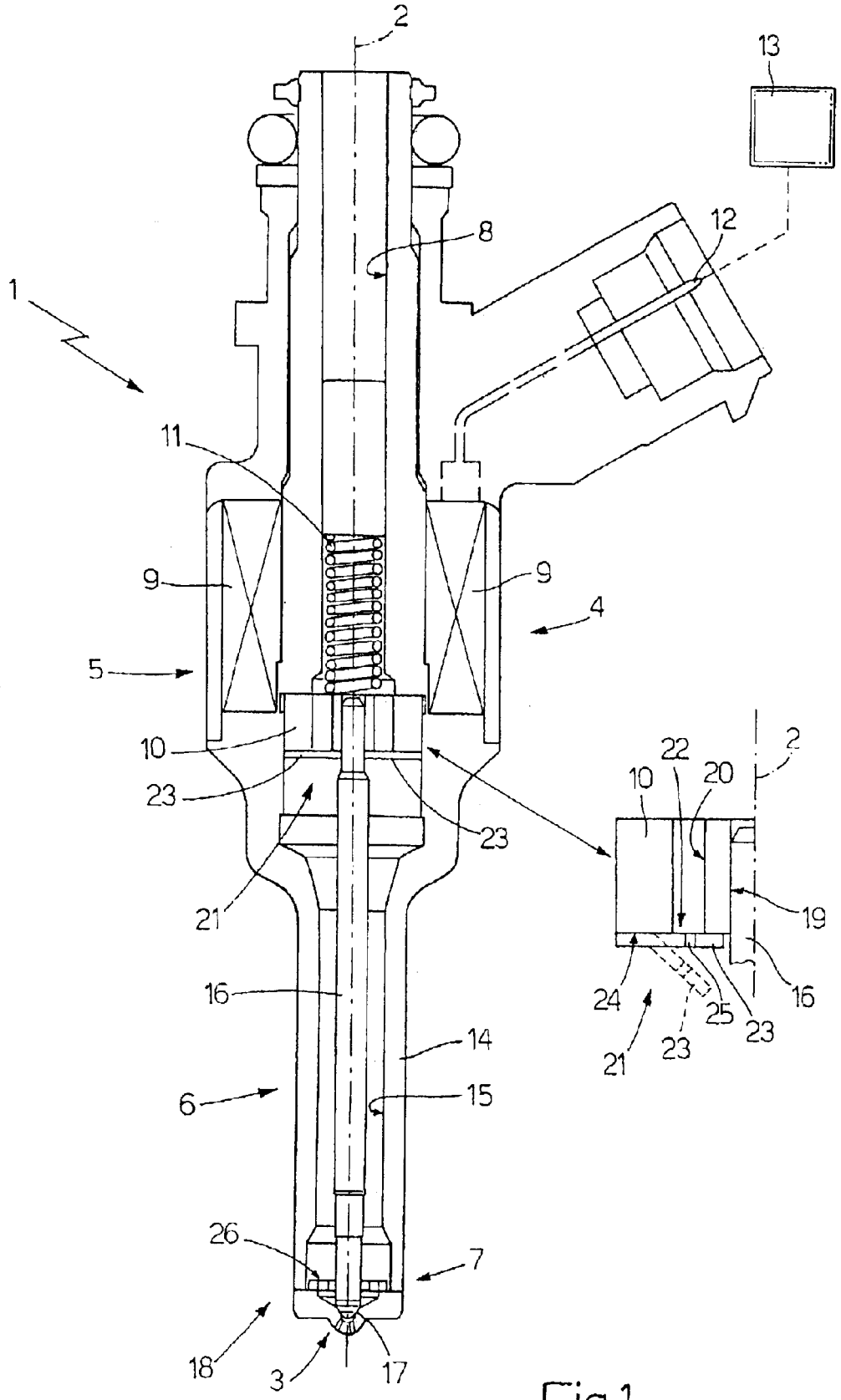
FIG. 1 is a schematic, partially sectional, side view of a fuel injector produced according to the present invention.

In FIG. 1 the number 1 denotes the petrol injector as a whole, which is substantially cylindrically symmetrical around a longitudinal axis 2 and is capable of being operated so as to inject petrol from an associated injection nozzle 3. The injector 1 comprises an upper actuator body 4 accommodating an electromagnetic actuator 5, and a lower valve body 6, which is made integral with the actuator body 4 and accommodates a valve 7 actuated by the electromagnetic actuator 5 so as to control the flow of petrol from the injection nozzle 3; the actuator body 4 accommodates the electromagnetic actuator 5 and comprises an internal channel 8 that extends along the entire length of the actuator body 4 in order to supply pressurised petrol to the valve body 6.

The electromagnetic actuator 5 comprises an electromagnet 9, which is provided with a 36-turn winding having a resistance of approx. 0.12 Ohm, is integral with the actuator body 4 and is capable of displacing along the axis 2 an armature 10 of ferromagnetic material accommodated in a lower portion of the internal channel 8 from a closed position (illustrated in the attached figures) to an open position (not illustrated) against the action of a spring 11 that tends to keep the armature 10 in the closed position. Moreover, the electromagnet 9 is electrically connected by means of electric cables 12 to a control unit 13, which is capable of controlling the electromagnet 9 by applying across the electromagnet 9 a voltage v(t), variable over time, in order to cause a current i(t), variable over time, to pass through the electromagnet 9 itself and thus bring about the displacement of the armature 10 between said closed position and said open position.

The valve body 6 comprises a tubular container 14 that is substantially cylindrical and comprises a central cylindrical cavity 15, which accommodates a plug or plunger 16 comprising an upper portion integral with the armature 10 and co-operating with a valve seat 17 in order to control the flow of petrol from the injection nozzle 3, in a known manner. The cavity 15 extends along the entire length of the tubular container 14 and is closed at the bottom in a fluid-tight manner by a sealing element 18 in which the valve seat 17 is defined.

The armature 10 is cylindrical in shape (it is known in the art as a "button armature"), completely occupies a lower portion of the internal channel 8, comprises a central hole 19 occupied by an upper portion of the plunger 16 and a series of through-holes 20 distributed symmetrically around the central hole 19 to allow petrol to flow towards the valve body 6. The armature is accommodated in sliding manner inside the internal channel 8 so that it can be moved along the axis 2 between the stated open and closed positions by the force of the electromagnetic actuator 5; as a result of the above-described structure, the armature 10 also performs the function of an upper guide for the plunger 16, i.e. it helps to keep the plunger 16 aligned with the valve seat 17 and allows the plunger 16 itself to be displaced by the thrust of the electromagnetic actuator 5.

Moreover, the armature 10 is provided with an antirebound device 21 of the hydraulic type comprising respective valve elements 22, each of which is paired with a respective through-hole 20 of the armature 10 and has a different permeability to the passage of petrol depending upon the direction of passage of the petrol itself through the through-hole 20. In particular, each valve element 22 comprises a resilient sheet 23, which is in part fixed to a lower surface 24 of the armature 10 on only one side of the respective through-hole 20 and comprises a central hole 25 of smaller dimensions; when the petrol flows downwards, i.e. towards the valve seat 17, the sheet 23 deforms under the force of the petrol, allowing the petrol to flow substantially freely through the hole 20, while, when the petrol flows upwards, the sheet 23 is pressed against the lower surface 24 of the armature 10 by the force of the petrol, closing the hole 20 and only allowing the petrol to flow through the smaller dimension hole 25.

As is illustrated in FIGS. 2 to 5, the sealing element 18 is provided with a multihole atomiser 26, is cylindrically symmetrical around the longitudinal axis 2 and is of greater dimensions than those of the internal cavity 15 of the tubular container 14, such that it rests upon a lower surface of the tubular container 14; this type of construction is preferable because it makes it possible to carry out welding of the sealing element 18 and the tubular container 14 at the level of the side surface of the tubular container 14 itself and thus relatively remotely from the injection nozzle 3.

The sealing element 18 is composed solely of a cylindrically symmetrical main body 27, which comprises the valve seat 17 and ensures the fluid-tight closure of the lower end of the tubular container 14, and of a perforated disc 28, which is welded coaxially to the main body 27 and defines the multihole atomiser 26 in conjunction with an underlying truncated conical surface 29 defined in the main body 27.

In particular, the perforated disc 28 comprises a central through-hole 30 for passage of the plunger 16 and a series of peripheral through-holes 31 distributed symmetrically around the central hole 30 for passage of the petrol towards the underlying valve seat 17 located in the centre of the truncated conical surface 29; the plunger 16 occupies in sliding manner the central hole 30 of the perforated disc 28, which acts as a lower guide for the plunger 16.

The valve seat 17 comprises a central hole 32, which is connected coaxially to the truncated conical surface 9, is occupied in service by a pointed end portion of the plunger 16 so as to interrupt the flow of petrol, and opens into an injection chamber 33 comprising a number of free injection through-holes 34, which define the injection nozzle 3.

Figure 2:
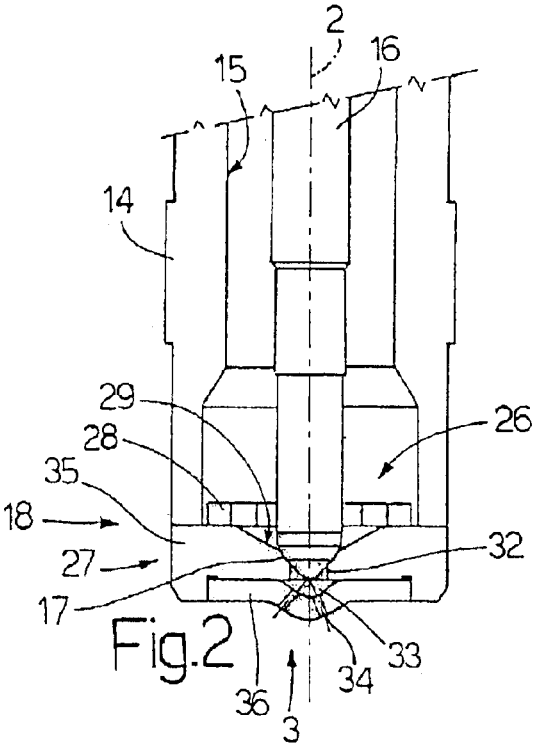
FIGS. 2 and 4 are magnified, sectional views of alternative embodiments of the valve body in FIG. 3.

According to the embodiment illustrated in FIG. 2, the main body 27 is composed of a first element 35, which comprises the valve seat 17 and ensures fluid-tight closure of the lower end of the tubular container 14, and of a second element 36, which defines a lower wall of the injection chamber 33 provided with the injection holes 44. The first element 35 is obtained from a respective solid disc (not illustrated) processed by removal of material (typically by means of drilling and milling) or directly by forming, and the second element 36 is obtained from a respective solid disc (not illustrated) processed by forming.

Figure 3:
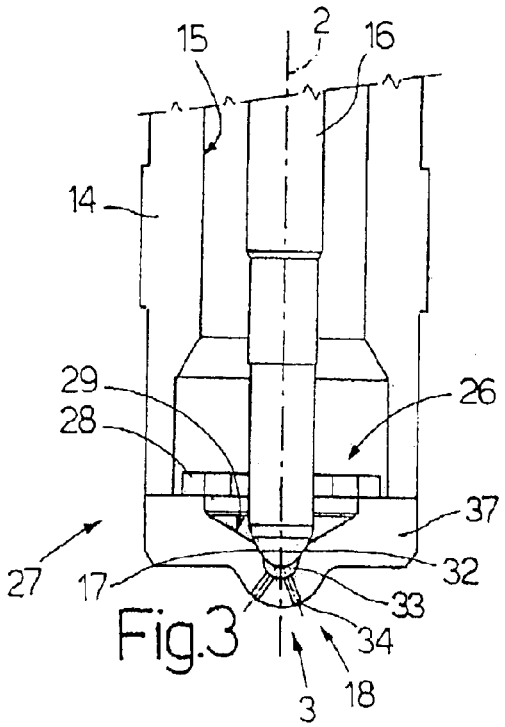
FIG. 3 is a magnified, sectional view of an end portion of a valve body in FIG. 1.
Figure 4:
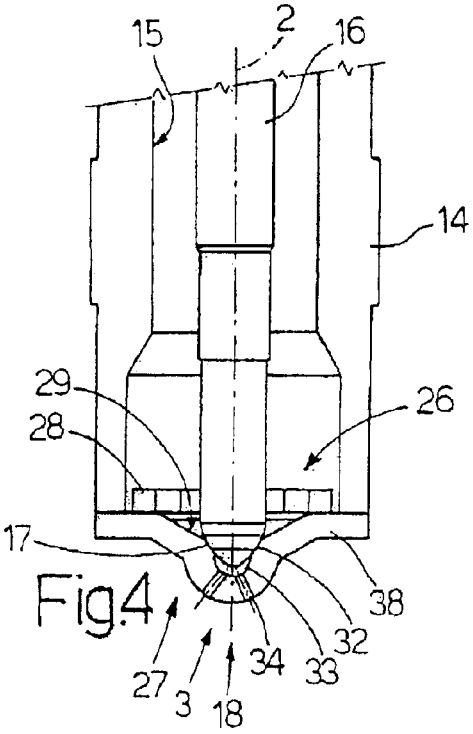
Figure 5:
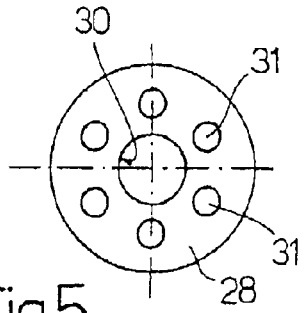
FIG. 5 is a plan view of a disc defining part of a multihole atomiser present in the valve body in FIGS. 2, 3 and 4.

According to the embodiment illustrated in FIG. 3, the main body 27 is composed of a single element 37 obtained from a respective solid disc (not illustrated) processed by removal of material (typically by means of drilling and milling). According to the embodiment illustrated in FIG. 4, the main body 27 is composed of a single element 38 obtained from a respective solid disc (not illustrated) processed by forming. Because of the structure thereof, production of the elements 37 and 38 is particularly simple and economic and makes it possible to reduce the production costs for the injector 1.

What is claimed is:

1. Fuel injector for an internal combustion engine; the injector (1) being provided with a valve body (6), which comprises a valve (7) capable of controlling the flow of fuel and a cylindrical, tubular container (14) comprising a central cylindrical cavity (15), and with an electromagnetic actuator (5) to operate the valve (7); the valve body (6) furthermore comprising a sealing element (18), which is arranged so as to close a lower end of the tubular container (14) and is provided with a multihole atomiser (26) and a valve seat (17), and a plunger (16), which is capable of occupying the valve seat (17), is accommodated in sliding manner within the tubular container (14), and is set in motion by the electromagnetic actuator (5) in order to open and close the injector (1); the sealing element (18) being composed solely of a cylindrically symmetrical main body (27), which comprises the valve seat (17) and ensures fluid-tight closure of the lower end of the tubular container (14), and of a perforated disc (28), which is welded coaxially to the main body (27) and defines the multihole atomiser (26) in conjunction with an underlying truncated conical surface (29) defined in the main body (27); the electromagnetic actuator (5) comprising a fixed coil and a mobile cylindrical armature (10) that is attached mechanically to an upper part of the plunger (16); an upper guide of the plunger (16) being defined by the armature (10) and a lower guide of the plunger being defined by the atomiser (26); the injector (1) being characterised in comprising an internal channel (8) through which the fuel is supplied to the valve seat (17); the internal channel (8) being completely occupied by the armature (10), which comprises at least one supply through-hole (20) for passage of fuel towards the valve seat (17) and is provided with an antirebound device (21) of the hydraulic type; the valve seat (17) comprising a central hole (32), which is occupied by the plunger (16) and opens into an injection chamber (33) comprising a number of free injection through-holes (34), which define an injection nozzle (3).

2. Injector according to claim 1, in which the antirebound device (21) of the hydraulic type comprises a valve element (22), which is paired with the supply hole (20) of the armature (10) and has a different permeability to the passage of fuel depending upon the direction of passage of the fuel itself through the supply hole (20).

3. Injector according to claim 1, in which the perforated hole (28) comprises a central through-hole (30) for passage of the plunger (16) and a series of peripheral through-holes (31) distributed symmetrically around the central hole (30) for passage of the fuel towards the underlying valve seat (17).

4. Injector according to claim 1, in which the cylindrically symmetrical main body (27) is composed of a first element (35), which comprises the valve seat (17) and ensures fluid-tight closure of the lower end of the tubular container (14) and of a second element (36), which defines a lower wall of the injection chamber (33) provided with the injection holes (34).

5. Injector according to claim 4, in which the first element (35) is obtained from a respective solid disc processed by removal of material, and the second element (36) is obtained from a respective solid disc processed by forming.

6. Injector according to claim 5, in which the first element (35) and second element (36) are obtained by forming.

7. Injector according to claim 4, in which the cylindrically symmetrical main body (27) is composed of a single element (37) obtained from a respective solid disc processed by removal of material.

8. Injector according to claim 4, in which the cylindrically symmetrical main body (27) is composed of a single element (38) obtained from a respective solid disc processed by forming.

* * * * *